United States Patent [19]

Liggett

[11] Patent Number: 4,735,469

[45] Date of Patent: Apr. 5, 1988

[54] AUDIO-VISUAL EQUIPMENT STATION WITH ADJUSTABLE TILT-TOP PODIUM AND STORAGE FEATURES

[76] Inventor: Philip R. Liggett, 8401 N. 51st Dr., Glendale, Ariz. 85302

[21] Appl. No.: 920,114

[22] Filed: Oct. 17, 1986

[51] Int. Cl.[4] ..... A47B 41/06

[52] U.S. Cl. ..... 312/233; 312/250; 108/6

[58] Field of Search ..... 108/6, 9, 5, 144; 312/233, 250, 223, 314; 248/455, 456, 457

[56] References Cited

U.S. PATENT DOCUMENTS

| | | | |
|---|---|---|---|
| 2,522,296 | 9/1950 | Overstedt | 108/9 |
| 3,087,767 | 4/1963 | Schell | 312/250 |
| 3,156,510 | 11/1964 | Hindin et al. | 312/223 |
| 3,351,402 | 11/1967 | Miller | 312/233 |
| 4,136,622 | 1/1979 | Bue et al. | 312/314 |
| 4,244,632 | 1/1981 | Molinari | 312/233 |
| 4,373,761 | 2/1983 | Hansberry | 312/250 |

*Primary Examiner*—Kenneth J. Dorner
*Assistant Examiner*—Gerald A. Anderson
*Attorney, Agent, or Firm*—Herbert E. Haynes, Jr.

[57] ABSTRACT

An audio-visual equipment station comprises a podium portion and a projector support portion. The podium portion includes a base member, a front wall, and a pair of upstanding, spaced apart side walls, each side wall having inclined top edges. A planar top surface is hingedly connected to the front wall, allowing the top surface to be pivoted from a rest position in which it is supported on the inclined top edges of the side walls to a nearly vertical position in which the surface may be used as an easel. A locking bar is provided for locking the surface in the nearly vertical position. In addition, an adjustment bar is provided for supporting the surface in a variety of positions between the rest position and the nearly vertical position. The projector support portion of the equipment station includes a base member, which is a lateral extension of the base member of the podium portion. The base member is provided with a plurality of keyhole-shaped sockets for receiving overhead marking pens, as well as electrical outlets attached to an extra long extension cord which is stored in a special compartment in the front of the podium structure.

9 Claims, 2 Drawing Sheets

AUDIO-VISUAL EQUIPMENT STATION WITH ADJUSTABLE TILT-TOP PODIUM AND STORAGE FEATURES

BACKGROUND OF THE INVENTION

1. Field of the Invention

This invention relates generally to the fields of classroom equipment and demonstration aids. More particularly, it relates to a mobile audio-visual equipment station including a tilt-top podium, a stand for an overhead projector, and various storage and material-organization features.

2. Description of the Prior Art

Any good teacher, lecturer, salesman or other public speaker is well aware of the importance of audio-visual aids in capturing the audience's attention. Most people tend to lose interest in a straight, unillustrated speech or lecture within just a few minutes, and are unable to remember what they have heard for any significant period of time. However, when the speech is accompanied by slides, diagrams, tape recorded sounds and other special effects, the audience is much more likely to remain attentive, and to mentally retain the information which has been delivered. Thus, it is desirable to use audio-visual aids whenever possible.

Unfortunately, many audio-visual (AV) presentations are marred by disorganized set-ups, which can cause the speaker to waste time, and to distract the audience's attention from the presentation. For instance, in a typical classroom set-up, there may be a stationary podium located in the front of the classroom, an easel for displaying materials off to one side of the podium, and AV equipment such as slide projectors, overhead projectors and phonographs set up on another surface such as a student's desk at the front of the room. If the teaches wishes to illustrate a lecture with slides or transparencies, it is necessary for him or her to step away from the podium, turn on the projector and make adjustments to the projector angle if necessary. It may even be necessary to prop the projector up with books if the front legs of the projector are too short. In the meantime, the teacher may find that he or she has misplaced the lecture notes, or that a student has walked away with the AV pens for marking the transparencies. He or she may also have to walk across the room several times again in order to point out material displayed on the easel, or elsewhere. All of this causes a lot of unnecessary fumbling about which interrupts the lecture and detracts from the speaker's overall effectiveness.

Various improved podium structures have been designed in the past in order to overcome some of the above-mentioned difficulties associated with public speaking and audio-visual demonstrations. For instance, wheeled podiums have been created which enable the speaker to move about the lecture area with ease. Some podiums have been equipped with various storage features, allowing the speaker to organize his or her notes and other materials in a neat, accessible way. However, none of the prior art podiums have fully succeeded in meeting all of the needs of the teacher or public speaker. For instance, some of the mobile podiums currently available are provided with integral electrical outlets and extension cords. However, such prior art electrical elements are cumbersome to use due to the cord storage devices used thereon. Another problem has been that none of the tops of the prior art podiums are tiltable and none are available in which the top surface can be supported in a vertical position for use as an easel. In addition, although some podiums have included features such as shelves for storing standard-sized file folders and loose papers, they lack facilities for storing oversized materials and small, easily lost or stolen materials such as AV pens or the like.

Therefore, a need exists for a new and improved mobile podium structure which overcomes some of the problems and shortcomings of the prior art.

SUMMARY OF THE INVENTION

In accordance with the present invention, a mobile audio-visual equipment station including a new and improved tilt-top podium structure, a support for an overhead projector, and various storage features for arranging educational materials in an organized fashion is disclosed. The station is also provided with an improved storage capability for an integrally attached power cord and has an electrical outlet which facilitates connection of the station to a convenient outlet, and provides the station with multiple outlets.

The station consists of a wheeled structure having a podium portion and a projector support portion integrally connected to one another. The podium portion includes an elongated base member, a pair of spaced apart, parallel side walls extending normally to the base member, and a front wall which extends normally to said base member and to both of the side walls. Each of the side walls is trapezoidal in shape, having a horizontal bottom edge, an inclined top edge, and a pair of parallel, vertical edges, the longer of which defines the forward edge of the podium. A planar top surface is pivotably mounted to said front wall, allowing the top to swing from a rest position in which it is supported on the inclined top edges of the trapezoidal side walls to a nearly vertical position in which it may be used as an easel. Means for locking the top surface in this vertical position are also provided. The rear portion of the podium is open, providing access to a storage cavity defined by the front and side walls and base of the podium structure. The storage cavity in turn is divided into a number of smaller compartments for storing materials of different sizes, including one compartment in the rear of the cavity for storing oversized materials.

The projector support portion of the station comprises a lateral extension of the base member of the podium portion. The extension is bounded on one side by one of the trapezoidal side walls of the podium structure, and on its opposite side by a low rectangular wall. Another low rectangular wall extends across the front of the projector support. The rear side of the projector support is open, in order to allow an overhead projector to be easily slid or lifted off the base. In addition, the rear edge of the base of the support is provided with a plurality of keyhole-shaped sockets which match in shape and dimension the circumference of standard-sized caps for pens of the type used to mark overhead transparencies. This enables the speaker or demonstrator to press-fit a pen in a cap-down position into each of the sockets in such a way that the pen may be removed from the support, but the cap will remain in the socket. This discourages theft of the pens, since the marking pens are useless without their caps. Also, a user of the podium can extract and replace a pen with one hand and will not readily misplace a pen.

The base of the projector support portion of the station is also provided with electrical outlets and an attached extra long power cord for connecting the outlets on the base to outlets in the wall of the classroom or lecture room. This enables short-corded devices such as cassette players and phonographs to be set up on the station without the need for an additional, separate extension cord. In addition, an opening is provided in the bottom of oversized storage compartment of the podium portion of the station, for stowing the power cord while it is not in use.

Accordingly, it is an object of the present invention to provide a mobile audio-visual equipment station with a new and improved podium structure having an adjustable tilt-top that can be locked in a nearly vertical position for use as an easel.

Another object of the invention is to provide an audio-visual equipment station with improved storage features for storing oversized materials and small, easily lost or stolen objects such as marking pens.

Another object of the invention is to provide an audio-visual equipment station with electrical outlets and an attached power cord in order to obviate the need for a separate extension cord.

The foregoing and other objects of the present invention as well as the invention itself, may be more fully understood from the following description when read in conjunction with the accompanying drawings.

DESCRIPTION OF THE PREFERRED EMBODIMENT

Figure 1:
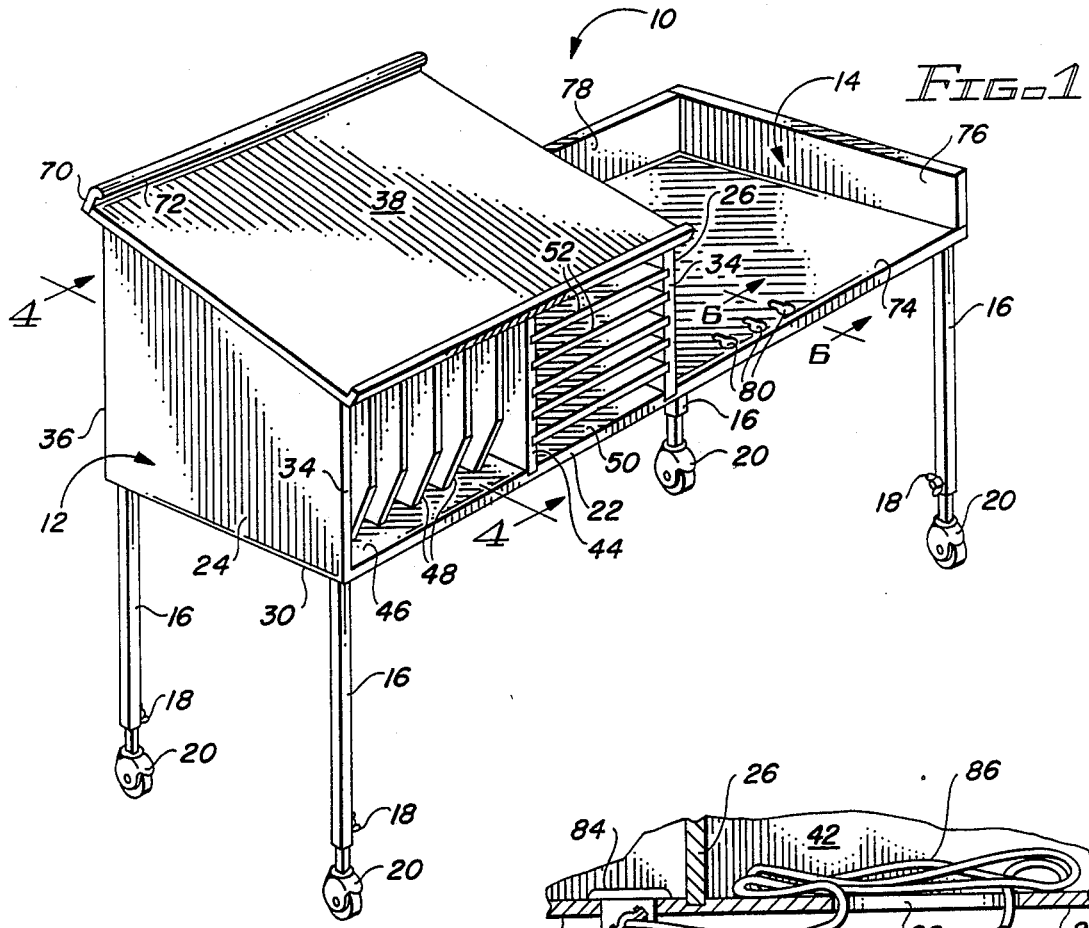
FIG. 1 is a perspective view from the rear of the audiovisual equipment station of the present invention.
Figure 3:
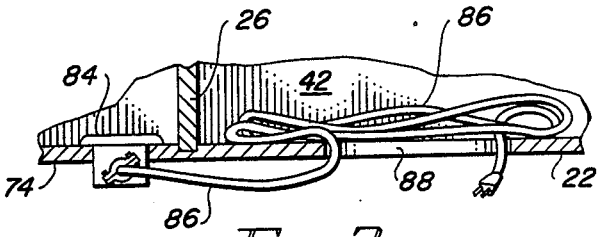
FIG. 3 is a fragmentary view taken along line 3—3 of FIG. 2.
Figure 2:
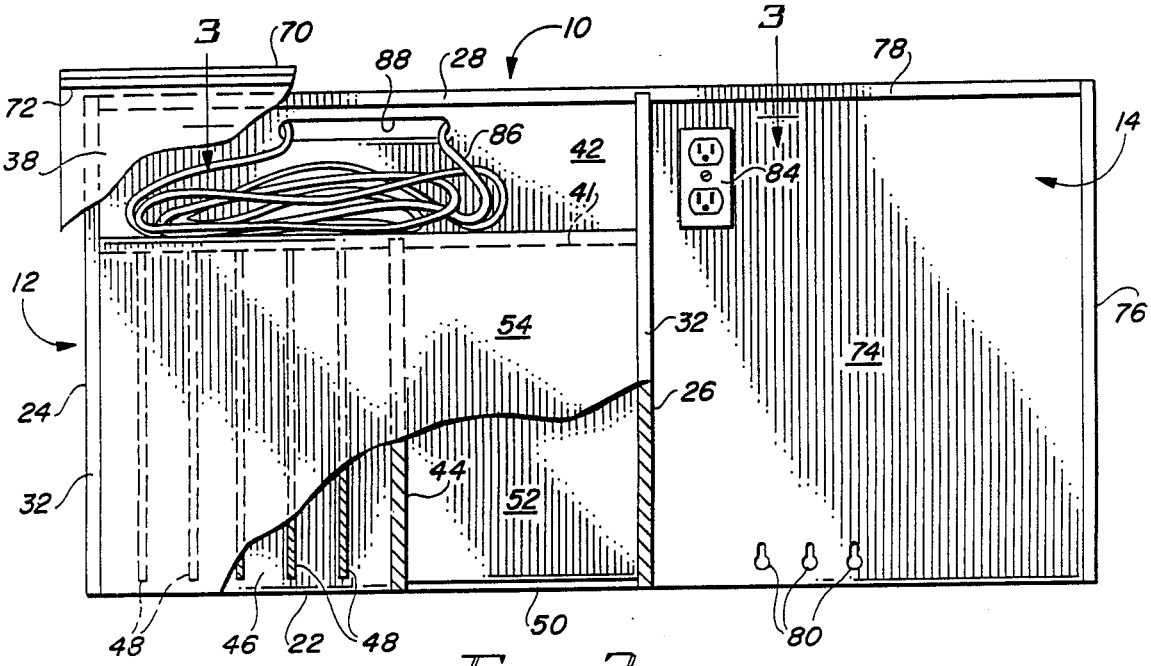
FIG. 2 is a top view, partially broken away, of the audiovisual equipment station.

Referring more particularly to the drawings, FIG. 1 shows the audio-visual equipment station of the present invention, generally indicated by the numeral 10. The station 10, including a podium portion 12 and a projector support portion 14, is supported by a plurality of wheel-mounted legs 16. Each of the legs is provided with means, such as telescopic adjustment means 18, of the type well-known in the art, for vertically adjusting the height of the station. In addition, the legs are provided with wheels 20 for enabling the station to be moved from one portion of a class or lecture room to another.

The podium portion 12 of the AV equipment station includes an elongated base member 22, a pair of spaced apart parallel side walls 24, 26 extending normally to the base member 22, and a front wall 28 which extends normally to said base member 22 and to the both of the side walls 24, 26. Each of the side walls 24, 26 is trapezoidal in shape, having a horizontal bottom edge 30, an inclined top edge 32, and a pair of parallel, vertical edges 34, 36, the longer of which, 36, defines the forward edge of the podium. A planar top surface 38 is mounted for pivotal movement about a horizontally extending hinge 40 which connects the top surface 38 to front wall 28. Thus, the top surface 38 may be swung from a rest position in which it is supported on the inclined top edges 32 of the trapezoidal side walls 24, 26 of the podium to a nearly vertical position in which the surface 38 may be used as an easel. The surface may also be supported in a number of other positions between the rest position and the nearly vertical position, as will later be described.

The rear portion of the podium 12 is open, providing access to a storage cavity defined by the front wall 28, side walls 24, 26 and base 22 of the podium structure 12. A first dividing wall 41 extends parallel to the front wall 28, dividing the storage cavity into two sections. The forwardmost of the two sections defines an oversized storage compartment 42 for storing large materials such as record albums and framed overhead transparencies, which do not fit in a standard filing cabinet. The rear section is further subdivided into two side-by-side compartments by a second dividing wall 44 which extends perpendicularly to the first dividing wall 40. A first of these compartments 46 is provided with a plurality of vertical dividers 48, defining vertical slots for storing standard-sized file folders, while the second compartment 50 is provided with a plurality of horizontal shelves 52 for storing mateials such as loose papers. Preferably, the horizontal shelves 52 are slidably disposed in the compartment 46 in a manner well-known in the art, in order to make it easier to sort through the materials stored therein. In addition, rear compartments 46 and 50 are provided with a ceiling 54 which extends perpendicularly to and rearwardly of first dividing wall 40, protecting the materials stored in compartments 46 and 50 when top surface 38 is lifted up.

Figure 4:
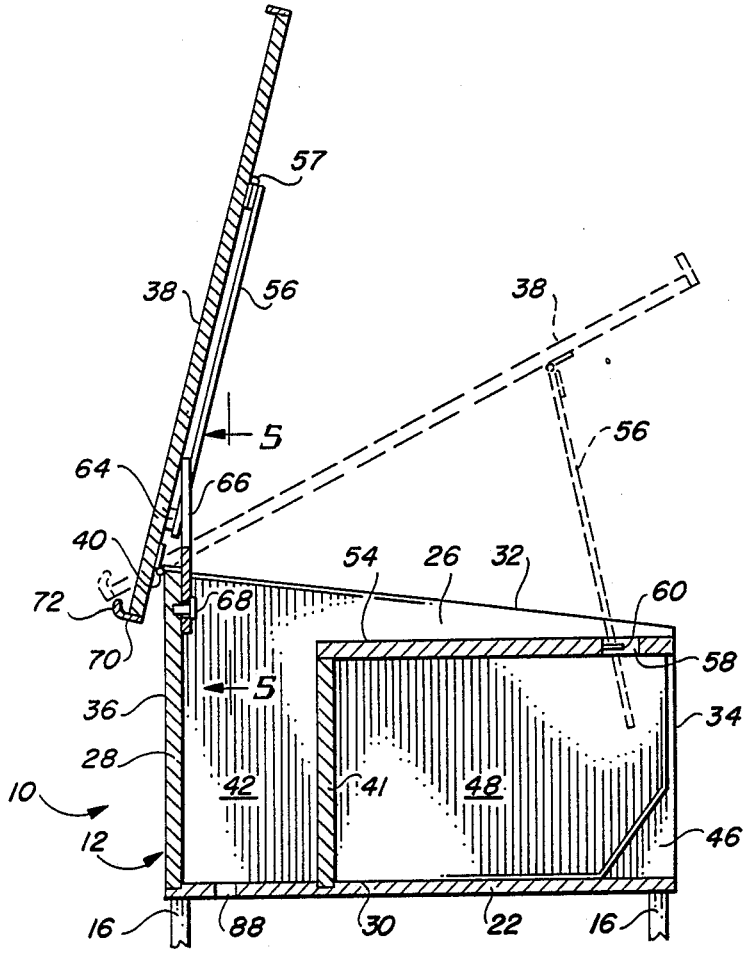
FIG. 4 is a sectional view taken along line 4—4 of FIG. 1, with the power cord removed for better visibility.
Figure 6:
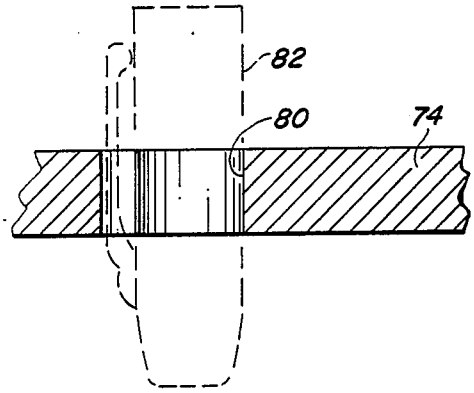
FIG. 6 is an enlarged fragmentary sectional view taken through line 6—6 of FIG. 1.
Figure 5:
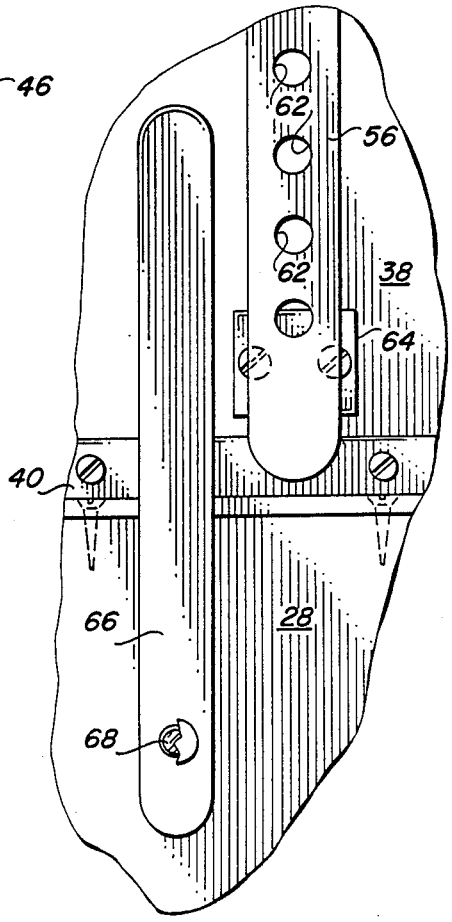
FIG. 5 is an enlarged fragmentary view taken along line 5—5 of FIG. 4.

FIGS. 4 and 5 illustrate the means for adjusting the angle of inclination of the top surface 38. The angle adjustment means comprises an apertured adjustment bar 56 having one end pivotally connected as at 57 to the underside of the top surface 38 of the podium and its opposite and receivable in a slot 58 provided in the ceiling 54 of storage compartments 46 and 50. In order to maintain top surface 38 in a tilted position as shown in phantom in FIG. 4, it is simply necessary to insert the bar 56 in the slot 58 in such a way that a peg 60 provided in the slot 58 is received in one of the plurality of apertures 62 formed in the bar 56. Then, in order to change the angle of inclination, it is simply necessary to reposition the bar 56 such that the peg 60 is received in a different one of the apertures 62. Thus, the top surface 38 may be tilted into a variety of positions, enabling the surface to be used in many different ways. For instance, a slide projector may be set up on the surface, and the angle of projection may be adjusted simply by tilting the surface rather than by adjusting the legs of the projector. In addition, the surface may be used as a demonstration table which can be inclined forwardly, allowing students or members of an audience to get a good view of objects being displayed and manipulated on the surface.

In order to set the top surface 38 in either the rest position or the nearly vertical position as shown by the solid outline in FIG. 4, the free end of apertured bar 56 is withdrawn from slot 58 and secured to the underside of top surface 38 to prevent it from swinging free and/or interfering with the contents of the storage compartments. Preferably, apertured bar 56 is made from a ferrous material, and the means for securing it to top surface 38 consists of a magnet 64 attached to the underside of the surface 38. However, other suitable fastening means may be employed as well. In addition, a locking bar 66 is provided for locking the top surface 38 in the upright, nearly vertical position. The locking bar 66 consists of a rigid rod or plate which is mounted at one end for rotation about a pivot pin 68 which projects from the inner surface of front wall 28 of the podium. In the unlocked position (not shown), locking bar 66 extends downwardly so that its free end hangs into the interior of oversized storage compartment 42. In the locked position, the locking bar is rotated 180° about pivot pin 68 so that the free end extends upwardly, propping the top surface 38 up into its nearly vertical position, where it can be used as an easel. In order to optimize the use of the top surface 38 as an easel, the forwardmost edge of the surface 38 is provided with an elongated, upstanding flange portion 70 having a rearwardly turned lip 72. Thus, the forward edge of the top surface 38, the flange 70, and the lip 72 together form a U-shaped channel at the forward portion of the podium. When the top surface 38 is tilted and locked into its nearly vertical position for use as an easel, the channel serves as a holder for supporting items such as posters and photographs on the bottom of the easel.

The projector support portion 14 of the podium 10 comprises a base member 74, which is an integral, lateral extension of base member 22 of the podium portion. Base member 74 is bounded on one side by the trapezoidal side wall 26 of the podium portion, and on the opposite side by a low rectangular wall 76. Another low rectangular wall 78 extends across the front of the projector support 14. Rectangular walls 76 and 78 should be high enough to prevent objects from being knocked off the support 14, but not so high as to obstruct light from an overhead projector (not shown) supported on the base 74 or to interfere with operation of the projector. The rear side of the projector support 14 is open, in order to allow the overhead projector to be slid or lifted off the base 74. In addition, the rear edge of the base 74 is provided with a plurality of keyhole-shaped sockets 80 which match in shape and dimension the circumference of standard-sized caps 82 for pens of the type used to mark overhead transparencies. This enables the speaker or demonstrator to press-fit a pen in a cap-down position into each of the sockets in such a way that the caps cannot easily be removed from the sockets.

The projector support portion 14 of the station 10 is also provided with electrical outlets 84, which are preferably located in the forward portion of the base element 74 of the projector support 14. An extra-long power cord 86 is permanently electrically coupled to the outlets 84 for connecting them to outlets in the classroom or lecture room wall. Thus, short corded devices such as tape recorders may be used at the station 10, even when the station has been wheeled a long distance from the nearest wall outlet. In addition, an opening 88 is provided in the bottom of oversized storage compartment 42, allowing the power cord to be stowed in the compartment 42 when the cord is not in use.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. An improved podium structure for an audio-visual equipment station, said structure comprising:

(a) an elongated base member;

(b) a pair of spaced apart, parallel side walls extending normally to said base member, each of said side walls having a horizontal bottom edge, an inclined top edge, and a pair of parallel, vertical edges, one of which is longer than the other;

(c) a front wall extending normally to said base member and joining said longer edges of said side walls;

(d) a planar top surface mounted for pivotable movement about the top edge of said front wall, said planar top surface normally being supported in a rest position on said inclined top edges of said side walls;

(e) a storage cavity defined by said front wall, side walls and base member of said podium structure;

(f) a first dividing wall extending parallel to said front wall dividing said storage cavity into a forward portion and a rear portion;

(g) a ceiling extending perpendicularly to and rearwardly of said first dividing wall for protecting said rear portion of said storage cavity;

(h) locking means for locking said planar top surface in a nearly vertical position in which said surface may be used as an easel;

(i) means for selectively supporting said planar top surface in plurality of intermediate positions between said rest position and said nearly vertical position, said means including, I. an adjustment bar having one end pivotally connected to the underside of said top surface of said podium structure, a free end opposite said pivotally connected end, and a plurality of vertically spaced apart apertures intermediate said ends, each of said apertures corresponding to a different one of said positions, II. a slot provided in said ceiling of said rear portion of said storage cavity, said slot being dimensioned to receive said free end of said adjustment bar; and III. a peg located within said slot, said surface being supported in one of said intermediate positions when said peg is received in the aperture corresponding to that position, and being supported in another position when said peg is received in a different one of said apertures; and (j) means for securing said free end of said adjustment bar to the underside of said planar surface when said planar top surface is locked in said nearly vertical position.

2. The podium structure of claim 1, in which said adjustment bar is made from a ferrous material, and said means for securing the free end comprises a magnet mounted on the underside of said planar top surface.

3. The podium structure of claim 1, in which said planar top surface has a forward edge, said forward edge including an elongated, upstanding flange portion and a rearwardly extending lip, said forward edge, said flange portion, and said lip together defining a U-shaped channel for holding items on said surface when said surface is maintained in its nearly vertical position.

4. The podium structure of claim 1, further comprising a projector support portion, said projector support portion including a lateral extension of said elongated base member of said podium structure.

5. The podium structure of claim 4 in which said projector support portion further includes electrical outlet means with a power cord attached thereto for connection to a remote power outlet located in a nearby wall, and in which said podium structure includes a hidden internal storage compartment for storing said power cord.

6. The podium structure of claim 5, in which said hidden internal storage compartment comprises said forward portion of said storage cavity, with an opening being formed in the bottom of said compartment for inserting and removing said power cord.

7. The podium structure of claim 4, in which said lateral extension is provided with at least one socket dimensioned to receive a marking pen.

8. The podium structure of claim 7 in which said at least one socket is keyhole-shaped, and matches in size and shape the circumference of a standard-sized cap for a marker of the type used to mark overhead transparencies, to allow said marker to be press-fit in a cap-down position in said socket.

9. The podium structure of claim 8, comprising a plurality of said sockets.

* * * * *